US007497355B2

(12) United States Patent
Horner et al.

(10) Patent No.: US 7,497,355 B2
(45) Date of Patent: Mar. 3, 2009

(54) DUAL FLUID CARTRIDGE WITH REDUCED FLUID WASTE

(75) Inventors: Terry A. Horner, Allentown, NJ (US); Robert W. Springhorn, Cream Ridge, NJ (US)

(73) Assignee: Nordson Corporation, Westlake, OH (US)

( * ) Notice: Subject to any disclaimer, the term of this patent is extended or adjusted under 35 U.S.C. 154(b) by 299 days.

(21) Appl. No.: 11/031,929

(22) Filed: Jan. 8, 2005

(65) Prior Publication Data

US 2006/0151530 A1 Jul. 13, 2006

(51) Int. Cl.

| | |
|---|---|
| ***B67D 5/52*** | (2006.01) |
| ***B67D 5/60*** | (2006.01) |
| ***B67D 5/42*** | (2006.01) |
| ***B65D 88/54*** | (2006.01) |

(52) U.S. Cl. ..... 222/137; 222/145.1; 222/327; 222/386

(58) Field of Classification Search ..... 222/129, 222/135, 137, 145.1, 327, 386

See application file for complete search history.

(56) References Cited

U.S. PATENT DOCUMENTS

| | | | | |
|---|---|---|---|---|
| 2,754,490 | A | | 7/1956 | Cohen |
| 3,370,754 | A | | 2/1968 | Cook et al. |
| 3,380,451 | A | | 4/1968 | Porter et al. |
| 3,437,242 | A | | 4/1969 | Poitras |
| 3,477,431 | A | | 11/1969 | Walecka |
| 3,595,439 | A | | 7/1971 | Newby et al. |
| 3,678,931 | A | | 7/1972 | Cohen |
| 3,682,174 | A | | 8/1972 | Cohen |
| 3,684,136 | A | | 8/1972 | Maumann |
| 3,760,503 | A | | 9/1973 | Baskas |
| 3,885,710 | A | | 5/1975 | Cohen |
| 4,014,463 | A | | 3/1977 | Hermann |
| 4,029,236 | A | | 6/1977 | Carson et al. |
| 4,159,570 | A | | 7/1979 | Baskas et al. |
| 4,220,261 | A | * | 9/1980 | White ..... 222/135 |
| 4,538,920 | A | | 9/1985 | Drake |
| 4,648,532 | A | | 3/1987 | Green |
| 4,771,919 | A | | 9/1988 | Ernst |
| 4,941,751 | A | | 7/1990 | Muhlbauer |
| 4,969,747 | A | | 11/1990 | Colin et al. |
| 4,986,443 | A | | 1/1991 | Saur et al. |

(Continued)

FOREIGN PATENT DOCUMENTS

| | | |
|---|---|---|
| DE | 19744746 | 4/1999 |

(Continued)

OTHER PUBLICATIONS

M. Eberwein, "European Search Report", Aug. 19, 2005, 3 pages.

(Continued)

*Primary Examiner*—Kevin P Shaver
*Assistant Examiner*—Melvin A Cartagena
(74) *Attorney, Agent, or Firm*—Wood, Herron & Evans, L.L.P.

(57) ABSTRACT

A dual fluid cartridge which reduces fluid waste while minimally increasing back pressure is disclosed. One embodiment of the dual fluid cartridge disclosed includes a post having a groove formed therein which allows more fluid to be dispensed from the dual fluid cartridge while simultaneously keeping the increase in back pressure within ranges still suitable for handheld cartridge applications.

16 Claims, 9 Drawing Sheets

U.S. PATENT DOCUMENTS

| | | | | |
|---|---|---|---|---|
| 5,058,770 | A | 10/1991 | Harold et al. | |
| 5,172,807 | A | 12/1992 | Dragan et al. | |
| 5,310,091 | A * | 5/1994 | Dunning et al. | 222/135 |
| 5,330,079 | A * | 7/1994 | Keller | 222/135 |
| 6,048,201 | A | 4/2000 | Zwingenberger | |
| 6,116,900 | A | 9/2000 | Ostler | |
| 6,328,715 | B1 | 12/2001 | Dragon et al. | |
| 6,398,761 | B1 | 6/2002 | Bills et al. | |
| 6,454,129 | B1 | 9/2002 | Green | |
| 6,634,524 | B1 | 10/2003 | Helmenstein | |
| 6,652,494 | B1 | 11/2003 | Dragon et al. | |
| 6,843,652 | B2 | 1/2005 | Xie et al. | |
| 6,848,480 | B2 * | 2/2005 | Brennan | 141/2 |
| 6,869,419 | B2 | 3/2005 | Dragon et al. | |

FOREIGN PATENT DOCUMENTS

| | | |
|---|---|---|
| DE | 10132417 | 1/2003 |
| FR | 2418173 | 9/1979 |
| WO | WO 2005/005305 | 1/2005 |
| WO | WO 2005005305 | 1/2005 |

OTHER PUBLICATIONS

D. Jelercic, "European Search Report", Apr. 18, 2006, 3 pages.

* cited by examiner

DUAL FLUID CARTRIDGE WITH REDUCED FLUID WASTE

BACKGROUND

Dual fluid cartridges are used to store and dispense two fluids which must be kept separate until the time of use and then, at the time of dispensing, need to be mixed together very quickly in a precise pre-set ratio to ensure that the proper chemical reaction takes place. If the cartridge does not dispense the two fluids properly in the required pre-set ratio, the final fluid mixture may be greatly affected and may not function or adhere as required. Examples of such fluids are those that are used to create thermoset adhesives (i.e., a resin and a hardener).

Dual fluid cartridges have been used in industry for the last twenty years and, over the years, differing types of dual fluid cartridges have been developed. FIG. 1 depicts one relatively recently developed dual fluid cartridge that has been particularly effective. Such dual fluid cartridges can be filled relatively easily and can be used in readily available dispensers, such as caulking guns as is shown in FIG. 2. An example of such a dual fluid cartridge that is presently in use is depicted in FIG. 3. Another example is described and depicted in U.S. Pat. No. 5,310,091, entitled "Dual Product Dispenser", ("'091 patent") which is commonly owned with this application and is incorporated by reference herein. However, with designs such as the one depicted in FIG. 3, there tends to be a significant amount of residual fluid waste left in the cartridge once the product has been completely dispensed due to the open volume between the cartridge post, such as the post 82 in FIG. 3, and the inner diameter of the cartridge delivery tube, such as the delivery tube 54 in FIG. 3, through which such post 82 moves. Such residual waste increases cost due to the fluid left in the cartridge and also has the effect of potentially raising serious environmental and disposal issues, depending on the type of fluids being discharged. Much of this waste could be reduced or eliminated if the diameter of the post was increased in relation to the inner diameter of the delivery tube or, vice versa, if the diameter of the inner delivery tube was decreased in relation to the diameter of the post, as depicted in the figures of the '091 patent. However, because the post 82 completely fills the interior of the delivery tube 54 in such an approach, this type of approach has the very undesirable effect of increasing the back pressure generated as the fluids are pushed through the cartridge. This is a very significant drawback, considering that such cartridges are typically used in hand held applications and a cartridge design that generates any significant amount of back pressure causes the cartridge to be very difficult, if not impossible, to use.

Accordingly, there is a need for a dual fluid cartridge that is effective in reducing the residual waste left in a cartridge after all the product has been dispensed, while at the same time not generating an unacceptable level of back pressure.

SUMMARY

In accordance with one aspect of the present invention, a fluid cartridge for storing and dispensing two fluids including an outer cartridge wall defining an outlet and an open end opposite the outlet. A delivery tube is disposed within the outer cartridge wall and defines an outlet that is co-located with the outlet defined by the outer cartridge wall. A first piston is disposed between the outer cartridge wall and the delivery tube forming a first fluid chamber. A second piston is disposed within the outer cartridge wall between the first piston and the open end of the outer cartridge wall. A post connected to and extending from the second piston is in alignment with the delivery tube. The post has a groove formed in it along the length of the post. A fixed wall is disposed between the first piston and the second piston. The fixed wall and the second piston define a second fluid chamber, and means is present for transmitting force from the second piston to the first piston. According to other aspects of the present invention, the groove formed in the post may be kidney-shaped, square, round, formed in a channel shape or some other shape. The outer diameter of the post may also be approximately equal to the inner diameter of the of the delivery tube. In yet another embodiment of the present invention, passageways may be formed in the second fluid chamber for evacuating air trapped in the second chamber during the filling process.

According to another aspect of the present invention, a fluid cartridge for storing and dispensing two fluids including an outer cartridge wall defining an outlet and an open end opposite the outlet. A delivery tube is disposed within the outer cartridge wall and defines an outlet that is co-located with the outlet defined by the outer cartridge wall. A first piston is disposed between the outer cartridge wall and the delivery tube forming a first fluid chamber. A second piston is disposed within the outer cartridge wall between the first piston and the open end of the outer cartridge wall. A post connected to and extending from the second piston is in alignment with the delivery tube. The post has a groove formed in it along the length of the post. A fixed wall is disposed between the first piston and the second piston. The fixed wall and the second piston define a second fluid chamber, and a transmission structure is present for transmitting force from the second piston to the first piston. According to other aspects of the present invention, the groove formed in the post may be kidney-shaped, square, round, formed in a channel shape or some other shape. The outer diameter of the post may also be approximately equal to the inner diameter of the of the delivery tube. In yet another embodiment of the present invention, a step surface may be formed on the transmission structure and at least one passageway may be formed in the step surface for evacuating air trapped in the second chamber during the filling process. According to another aspect, at least one passageway may be formed in the second piston, and this passageway may be in communication with the passageway formed in the step surface formed on the transmission structure.

According to another aspect of the present invention, a fluid cartridge for storing and dispensing two fluids including an outer cartridge wall defining an outlet and an open end opposite the outlet. A delivery tube is disposed within the outer cartridge wall and defines an outlet that is co-located with the outlet defined by the outer cartridge wall. A first piston is disposed between the outer cartridge wall and the delivery tube forming a first fluid chamber. A second piston is disposed within the outer cartridge wall between the first piston and the open end of the outer cartridge wall. A post connected to and extending from the second piston is in alignment with the delivery tube. The post has at least one supply window formed therein near the second piston, and the post also has a passage formed throughout the center of the post that is in communication with the at least one supply window at one end and in communication with the delivery tube outlet at the other end. A fixed wall is disposed between the first piston and the second piston. The fixed wall and the second piston define a second fluid chamber, and a transmission structure is present for transmitting force from the second piston to the first piston.

According to yet another aspect of the present invention, a fluid cartridge for storing and dispensing two fluids to form a product including an outer cartridge wall defining an outlet and an open end opposite the outlet. A delivery tube having an inner diameter is disposed within the outer cartridge wall and defines an outlet that is co-located with the outlet defined by the outer cartridge wall. A first piston is disposed between the outer cartridge wall and the delivery tube forming a first fluid chamber to store and dispense a first fluid. A second piston is disposed within the outer cartridge wall between the first piston and the open end of the outer cartridge wall. A fixed wall is disposed between the first piston and the second piston. The fixed wall and the second piston define a second fluid chamber to store and dispense a second fluid, and a transmission structure is present for transmitting force from the second piston to the first piston, wherein the inner diameter of the delivery tube is of a diameter to allow no more than five milliliters of the second fluid to remain in the second chamber when the product is entirely dispensed. The delivery tube may be formed of an inner surface and an outer surface, wherein the inner surface defines the inner diameter. The delivery tube may also have a sidewall with thickness, wherein the sidewall thickness defines the inner diameter.

DESCRIPTION OF THE DRAWINGS

These and other features, aspects and advantages of the present invention will become better understood with regard to the following description, appended claims and accompanying drawings where:

DETAILED DESCRIPTION

Figure 1:
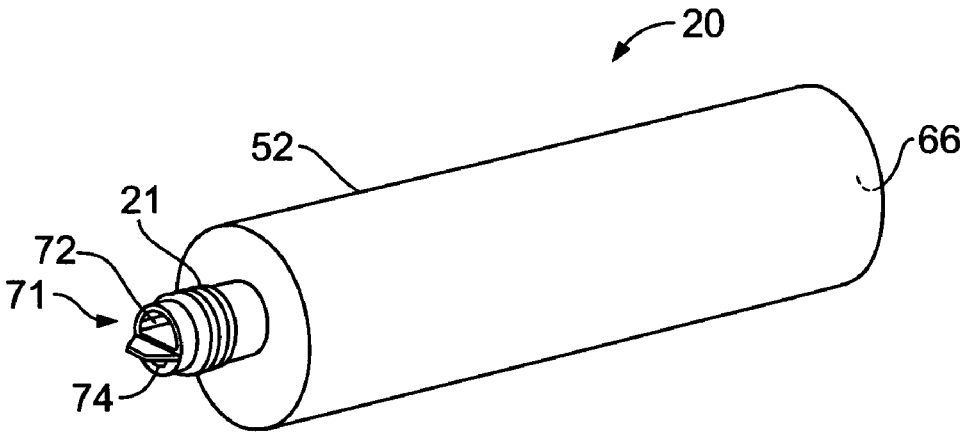
FIG. 1 depicts a dual fluid cartridge useable in readily available dispensers, such as caulking guns.
Figure 2:
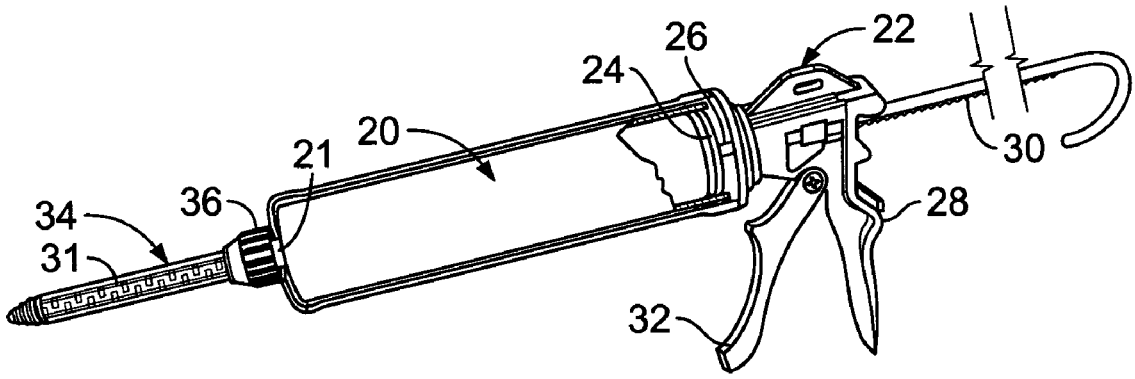
FIG. 2 depicts a dual fluid cartridge with a nozzle attached and with the dual fluid cartridge disposed in a dispenser, with a portion of the dual fluid cartridge and the dispenser broken away.

Referring to FIG. 1, a dual fluid cartridge 20 is depicted. The dual fluid cartridge 20 has an outlet 71 which includes an externally threaded outer outlet wall 21. As explained in detail below, the dual fluid cartridge 20 stores two fluids separately from one another until a user is ready to mix the fluids together using a dispenser. In FIG. 2, the dual fluid cartridge 20 is shown disposed in a dispenser 22, which in FIG. 2 is depicted as a standard manual caulking gun. However, it should be understood that the dual fluid cartridge 20 may be used with any form or type of dispenser 22 and is not limited to just manual caulking guns. For example, other dispensers 22 may have different shapes or sizes and may be actuated pneumatically, hydraulically, by battery power or by some form of mechanical drive, such as an actuating screw. The dispenser 22 shown in FIG. 2 has a plunger 24 which is connected to a rod 26 that extends through a handle 28 of the dispenser 22. The rod 26 has ratchet teeth 30 formed on the rear portion of the rod. The dispenser 22 also has a trigger 32 which, when actuated, engages the ratchet teeth 30, advancing the plunger 24 forward. The continued actuation of the trigger 32 causes the plunger 24 to eventually engage and apply pressure against the rear portion of the dual fluid cartridge 20, which, as explained in more detail below, causes the two fluids stored in the cartridge 20 to be dispensed and mixed together.

The dual fluid cartridge 20 in FIG. 2 also has a nozzle 34 attached to the end of the cartridge 20. In this embodiment, the nozzle 34 is attached to the dual fluid cartridge 20 by screwing a retaining nut 36 on to the threaded outer outlet wall 21 of the cartridge 20. Typically, the nozzle 34 contains a static mixer 31 within it. The static mixer 31 mixes the two fluids stored in the dual fluid cartridge 20 together as the dispenser 22 dispenses them from the cartridge 20.

Figure 4:
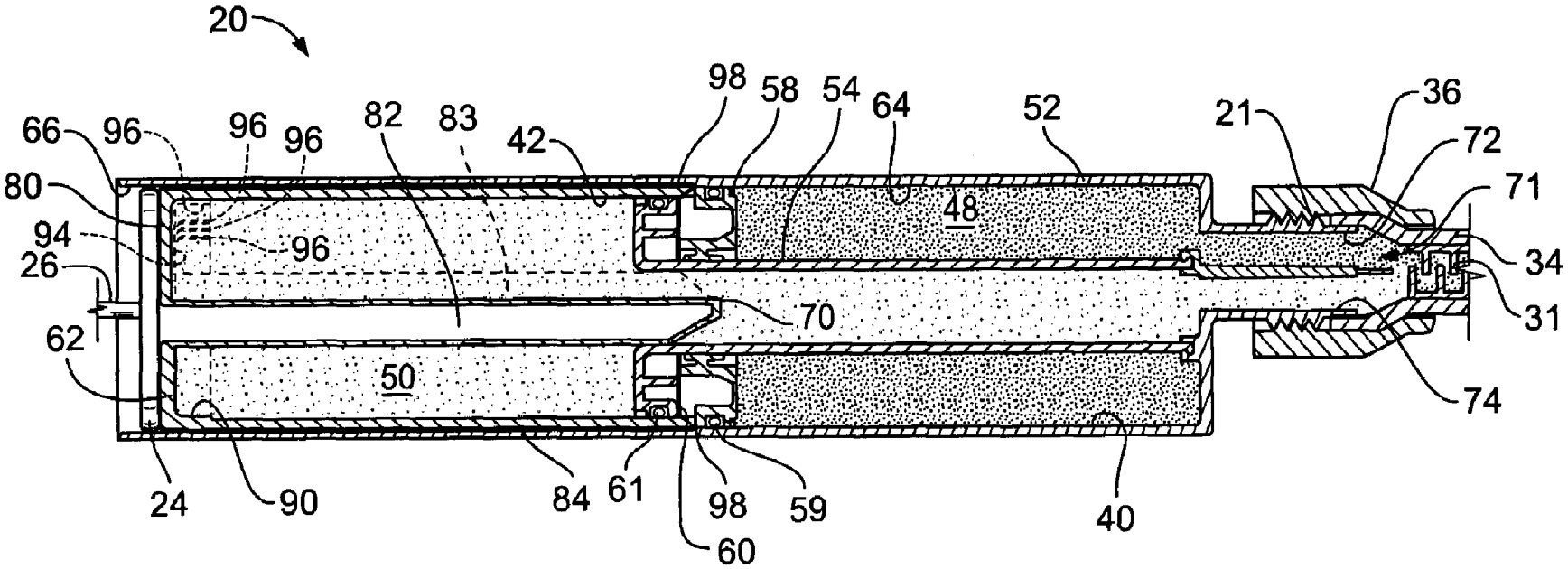
FIG. 4 is a longitudinal sectional view of a filled embodiment of a dual fluid cartridge of the present invention, which is depicted along with a portion of an attached nozzle and static mixer in section and the plunger and a portion of the rod of the dispenser depicted in FIG. 2.

Referring to FIG. 4, a longitudinal sectional view of an embodiment of a dual fluid cartridge 20 of the present invention is depicted. This embodiment of the dual fluid cartridge 20 defines a first fluid chamber 40 and a second fluid chamber 42 for storing and dispensing a first fluid 48 and second fluid 50 respectively. In this embodiment of the dual fluid cartridge 20, the cartridge 20, in addition, includes an outer cartridge wall 52, a delivery tube 54, a first piston 58 having an o-ring 59, a compression wall 60 having an o-ring 61 and a rear piston assembly 62. The outer cartridge wall 52 in this embodiment is a cylindrical wall defining a hollow interior 64. In a preferred embodiment, the outer cartridge wall 52 of the cartridge 20 is an industry standard design that is designed to fit into a standardized piece of dispensing equipment, such as a caulking gun as described above. The outer cartridge wall 52, in this embodiment, defines an opening 66 at one end and at the other end defines two discharge openings 72, 74 and includes the external threaded outer outlet wall 21.

The delivery tube 54 of the cartridge 20 is disposed within the hollow interior 64 of the outer cartridge wall 52. In this embodiment, the delivery tube 54 snaps into locking engagement with the outer cartridge wall 52, such that the delivery tube 54 is in fluid communication with the discharge opening 74. It is foreseen that the outer cartridge wall 52 and the delivery tube 54 may also be formed integral with one another. The compression wall 60 in this embodiment is formed integral with the delivery tube 54 which fixes the compression wall 60 in place.

The first piston 58 of the dual fluid cartridge 20 is disposed within the cartridge 20 between the exterior of the delivery tube 54 and the interior of the outer cartridge wall 52. In this embodiment, the first piston 58 surrounds the exterior of the delivery tube 54. The first piston 58, in conjunction with the exterior of the delivery tube 54 and the interior of the outer cartridge wall 52, defines the first fluid chamber 40.

Figure 5:
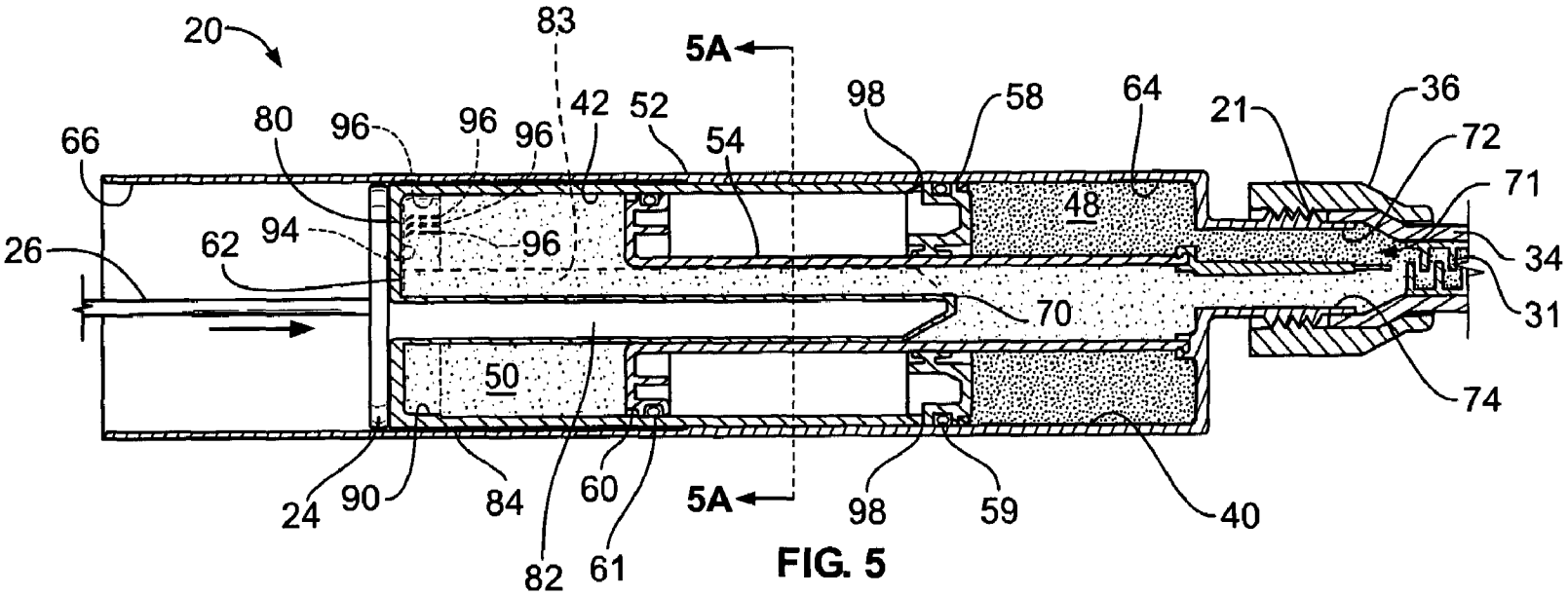
FIG. 5 is a longitudinal sectional view of the dual fluid cartridge depicted in FIG. 4 in an intermediate dispensing position.
Figure 5A:
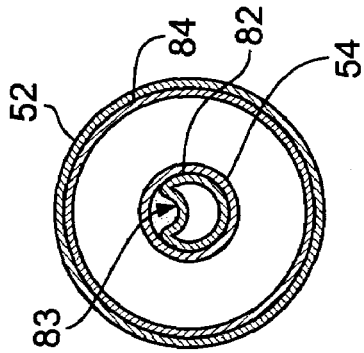
FIG. 5A is cross-sectional view taken along line 5A-5A of FIG. 5.

In this embodiment, the rear piston assembly 62 and the compression wall 60 define the second fluid chamber 42. The delivery tube 54 provides fluid communication between the second fluid chamber 42 and the discharge opening 74. The rear piston assembly 62 includes a rear piston surface 80, a post 82 with a groove 83 formed therein and a transmission structure 84. In this embodiment, the groove 83 formed along the length of the post 82 is formed in the shape of a kidney, as depicted in FIG. 5A. A kidney-shaped groove 83 provides a low friction factor; however, it should be understood that the groove 83 is not required to be kidney-shaped. The groove 83 may be formed in any shape appropriate (e.g. square, round or channel). Further, it should be understood that the differing portions 80, 82, 84 of the rear piston assembly 62 are all integral with one another in this embodiment, but this is not necessary. One of ordinary skill in the art would understand that it is possible that each portion of the rear piston assembly 62 could be its own separate structure. In this embodiment, the post 82 extends from the rear piston surface 80 of the rear piston assembly 62 and aligns with the interior of the delivery tube 54 for subsequent insertion and movement within the delivery tube 54 during dispensing of the fluids from the cartridge 20. In this embodiment, the transmission structure 84 extends from the rear piston surface 80 of the rear piston assembly 62, passes snugly between the compression wall 60 and the interior of the outer cartridge wall 52 forming a seal and is in engagement with the first piston 58.

To dispense the fluids from the dual fluid cartridge 20, the rear piston assembly 62 is pressed forward towards the cartridge outlet 71. In the embodiment described, this is done by actuation of the caulking gun plunger 24. As the plunger 24 is actuated forward, in the direction indicated by the arrow in FIG. 5, the plunger 24 presses against the rear piston assembly 62. Simultaneously, the rear piston surface 80 pushes against the fluid 50 stored in chamber 42, the post 82 enters into and moves within the interior of the delivery tube 54 and the transmission structure 84 presses against the first piston 58. The fluid 50 being pushed by the rear piston surface 80 in the chamber 42 gets compressed by the fixed compression wall 60, pushing the fluid 50 through the delivery tube 54 and through the discharge opening 74, where the fluid 50 is discharged from the dual fluid cartridge 20. At the same time, the pressing of the transmission structure 84 against the first piston 58 causes the fluid 48 in the first fluid chamber 40 to be pressed into the discharge opening 72, through which the fluid 48 is discharged from the dual fluid cartridge 20. As the fluids 48, 50 are discharged from the dual fluid cartridge through the discharge openings 72, 74, they are mixed together by the static mixer 31 in the nozzle 34.

Figure 6:
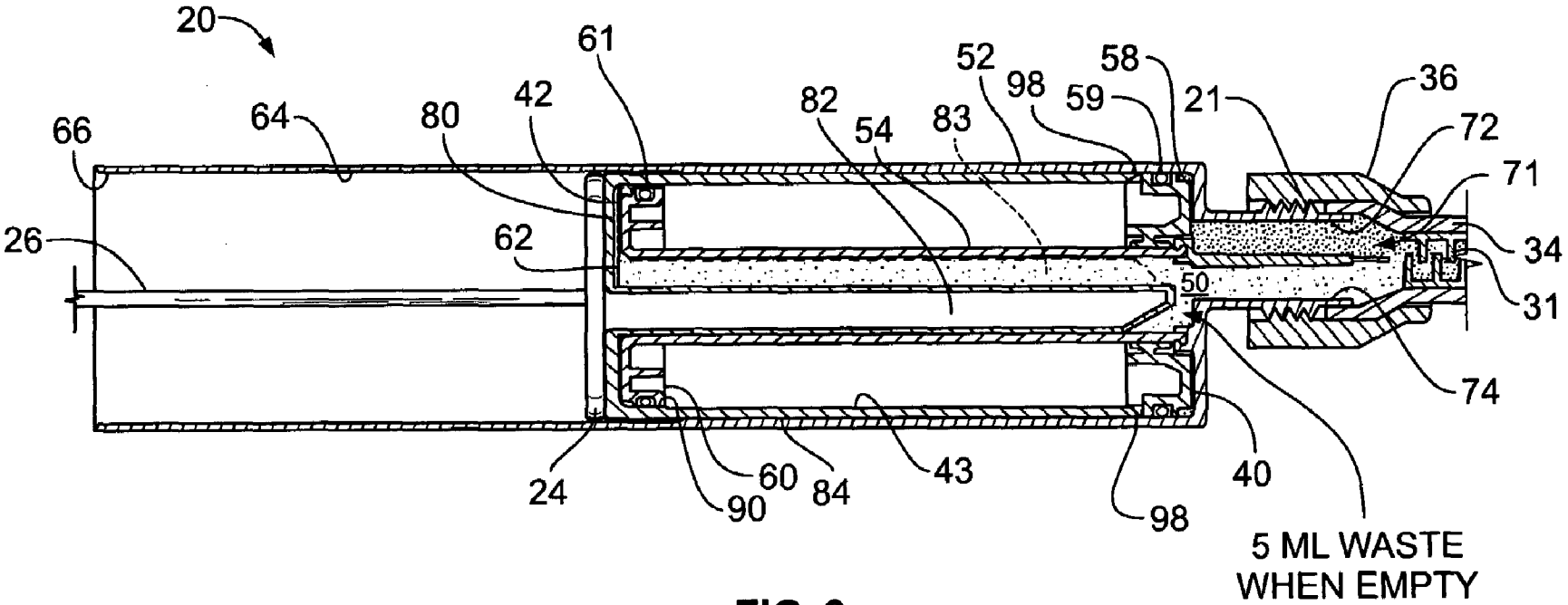
FIG. 6 is a longitudinal sectional view of the dual fluid cartridge depicted in FIG. 4 with the contents of the dual fluid cartridge dispensed.

This fluid discharge and mixing process continues as long as the caulking gun plunger 24 is being actuated and as long as fluids are still left to be dispensed from the dual fluid cartridge 20. FIG. 5 depicts the dual fluid cartridge 20 with a portion of the fluids 48, 50 dispensed from the dual fluid cartridge 20. FIG. 6 depicts the dual fluid cartridge 20 with the fluid contents of the chambers 40, 42 of the cartridge 20 fully dispensed. In this embodiment of the invention, only 5 milliliters of waste remain of the second fluid 50 when the entire product has been dispensed from the dual fluid cartridge 20. This is significantly improved over the 11 milliliters of waste of the second fluid 50 that was left in prior art dual fluid cartridge designs, such as the dual fluid cartridge design depicted in FIGS. 3 and 3A.

Figure 3:
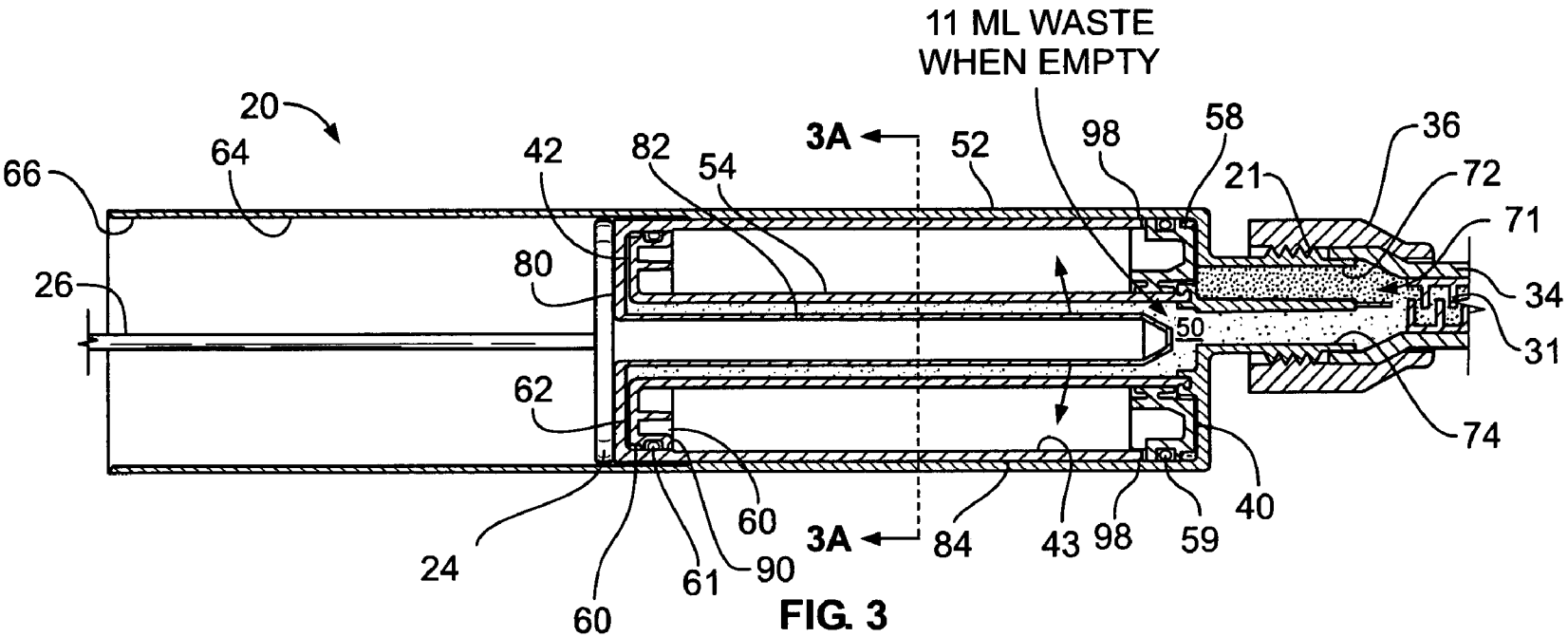
FIG. 3 (Prior Art)
FIG. 3 is a longitudinal sectional view of a prior art dual fluid cartridge with the contents of the dual fluid cartridge dispensed, which is depicted along with a portion of an attached nozzle and static mixer in section and the plunger and a portion of the rod of the dispenser depicted in FIG. 2.
Figure 3A:
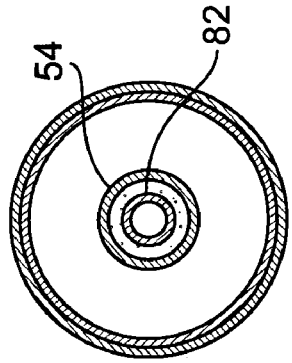
FIG. 3A is cross-sectional view taken along line 3A-3A of FIG. 3.

Referring to FIGS. 3 and 3A, the prior art dual fluid cartridge depicted has significant waste due to the amount of space left between the outer diameter of the post 82 and the inner diameter of the delivery tube 54. When product is fully discharged from the prior art dual fluid cartridge, most of the waste remaining in the cartridge 20 is in the space between the post 82 and the inner diameter of the delivery tube 54. As noted above, in the prior art embodiment depicted, there is 11 milliliters of waste. Increasing the diameter of the post 82 to take up the space between the post 82 and the inner diameter of the delivery tube 54 to reduce the amount of waste is impractical with the prior art design because as the diameter of the post 82 is increased, the amount of backpressure generated increases significantly as well. In contrast, the kidney-shaped groove embodiment of the present invention depicted in FIG. 4 reduces residual waste while minimally increasing back pressure because the groove 83 allows the post 82 to move more freely through the fluid being discharged. The kidney-shaped groove embodiment of the present invention requires around 15 pounds of force, while only leaving only 5 milliliters of waste. A cartridge of the prior art design of FIG. 3 which, by increasing the diameter of the post 82, achieves comparable residual waste of only 5 milliliters requires a significantly higher force of around 23 pounds—8 pounds more than the kidney-shaped embodiment of the present invention.

Figure 7A:
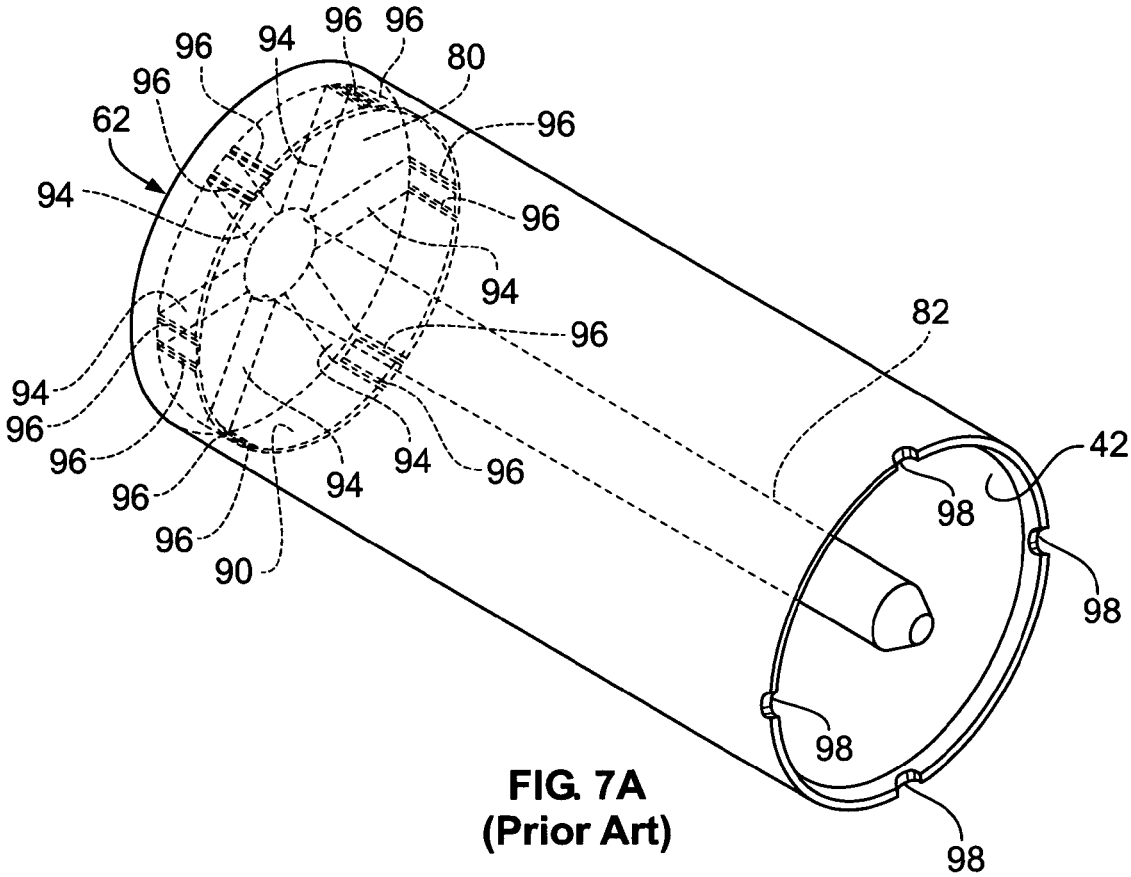
FIG. 7A (Prior Art)
FIGS. 7A and 7B are differing views of a rear piston assembly of the prior art dual fluid cartridge depicted in FIG. 3 showing air passageways.
Figure 7B:
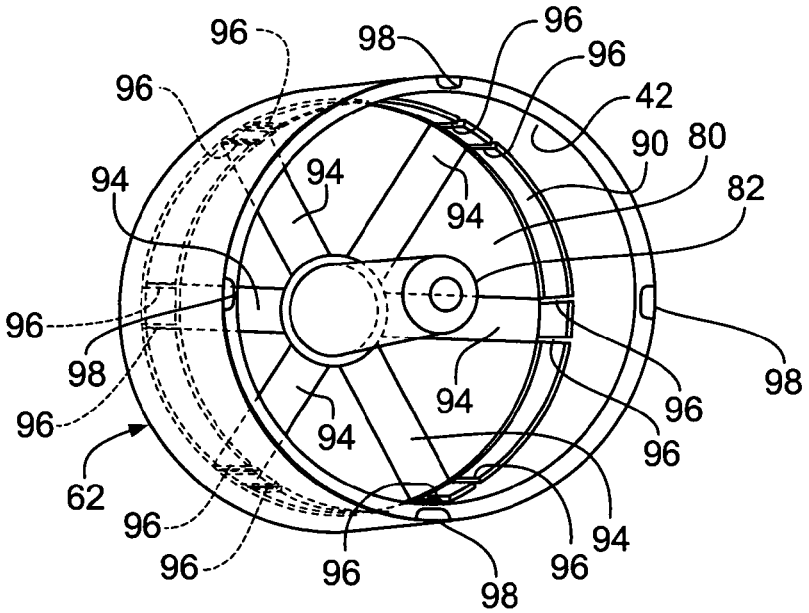
FIG. 7B (Prior Art)
Figure 8A:
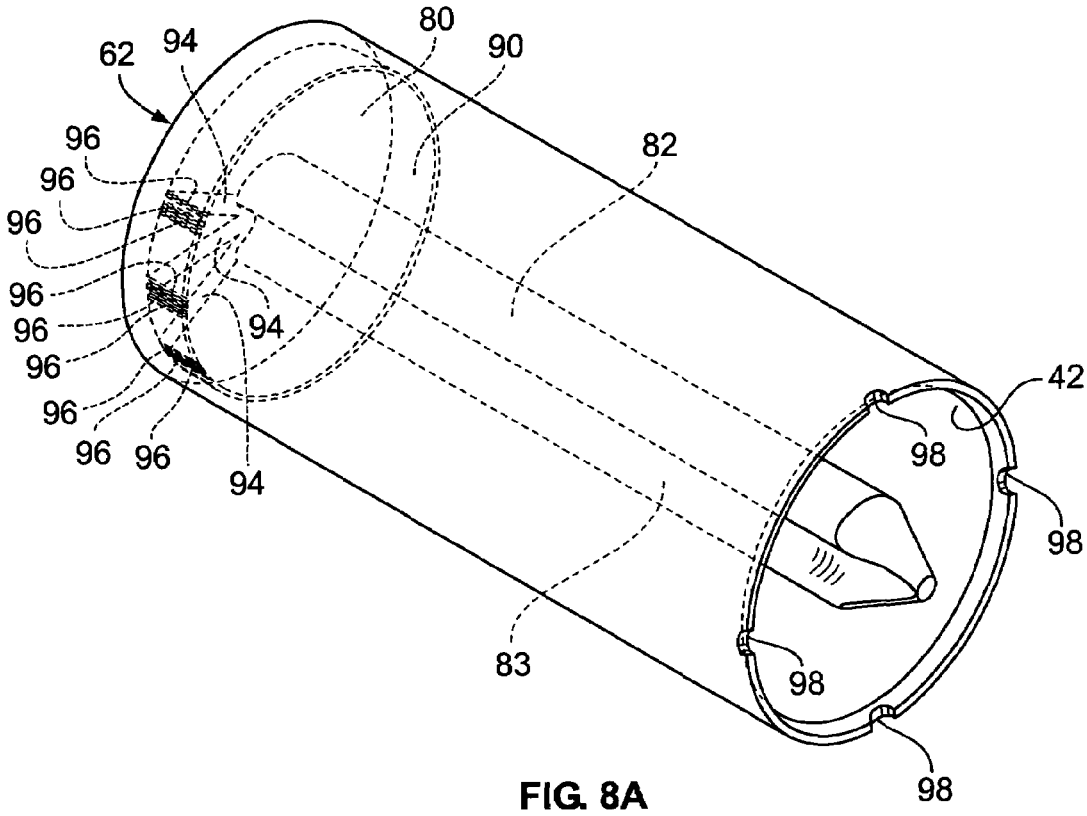
FIGS. 8A and 8B are differing views of a rear piston assembly of an embodiment of the dual fluid cartridge of the present invention depicted in FIG. 6 showing air passageways.
Figure 8B:
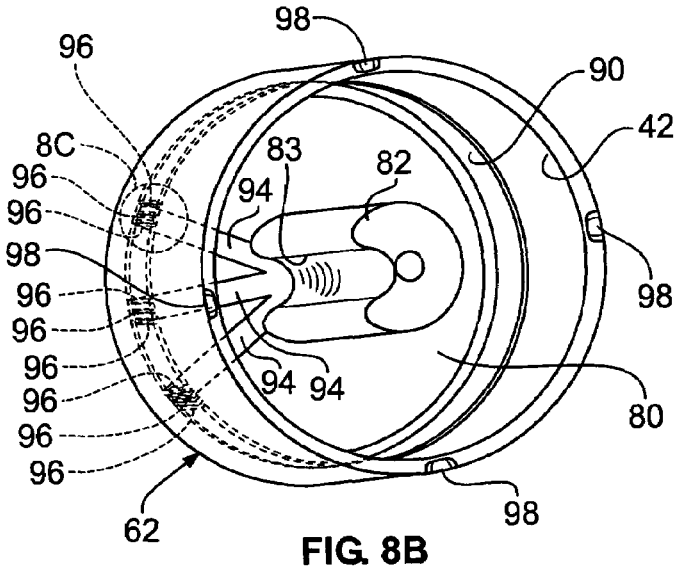
Figure 8C:
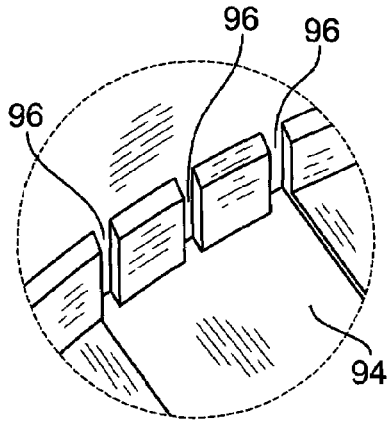
FIG. 8C is a detail view of the area 8C of FIG. 8B.

The arrangement of the dual fluid cartridge 20 in FIG. 6 is also how the dual fluid cartridge 20 looks prior to being filled. To fill the dual fluid cartridge 20, the chambers 40, 42 are filled with the appropriate fluids 48, 50 through their respective discharge openings 72, 74. The filling process occurs in the reverse manner of the dispensing process described above. During the filling process, air can get trapped in the second chamber 42 between the incoming fluid 50 and the rear piston surface 80. Air trapped in the chamber 42 can cause a number of problems in the use of the dual fluid cartridge 20. Most significantly, air trapped in chamber 42 can negatively impact the ability to control the volumetric dispensing ratio of the fluids 48, 50 in the chambers 40, 42. Referring to FIGS. 3 and 7A-B, to alleviate this problem, the prior art design of FIG. 3 has a small portion of the sidewall of the transmission structure 84 thickened to form a step 90 adjacent the rear piston surface 80. The rear piston surface 80 of the rear piston assembly 62 has air passageways 94 formed therein which are in communication with air passageways 96 that are formed in the step 90. The passageways 94, 96 act to allow air to vent past the o-ring 61 of the compression wall 60 into an open chamber 43 when the rear piston assembly 62 is the position indicated in FIG. 3. From the open chamber 43, the air ultimately flows through a series of slots 98 formed along the bottom of the rear piston assembly 62 and out to atmosphere through a separation between the transmission structure 84 and the interior of the outer cartridge wall 52. As the rear piston assembly 62 is pushed rearward as fluid 50 fills the chamber 42, the step 90 moves off of the o-ring 61 and the chamber 42 is sealed from the open chamber 43. Such a prior venting system is described in commonly owned international patent application No. PCT/US03/17997 and U.S. patent application Ser. No. 10/755,796, which are incorporated by reference herein.

Referring to FIGS. 6 and 8A-C, the kidney-shaped groove 83 in the post 82 of the embodiment of the present invention depicted improves the manner in which trapped air is vented from the chamber 42. In the kidney-shaped groove embodiment of the present invention, air enters the kidney-shaped groove 83 from the second chamber 42 and is pushed into one of three passageways 94, as opposed one of six passageways 96 present in the prior design as shown in FIGS. 7A-B. As a result, the groove 83, along with the reduction in passageways 94, provides a more directed flow path for venting air trapped in the chamber 42. This results in a more efficient and effective evacuation of air from the chamber 42.

Another advantage of the kidney-shaped groove embodiment of the present invention is that the grooved post 82 of the present invention does not move radially during the filling process as the post 82 of the prior art design is apt to do. Radial movement of the post 82 during the process filling generates inconsistent air flow in the chamber 42 which interferes with effective evacuation of air trapped in the chamber 42. The post 82 of the prior art design is able to move radially, as indicated by the arrows in FIG. 3, due to the space that exists between the post 82 and the inner diameter of the delivery tube 54. The grooved post 82 of the present invention does not have this problem because the grooved post 82 of the present invention fills the entire inner diameter of the delivery tube 54.

Figure 9:
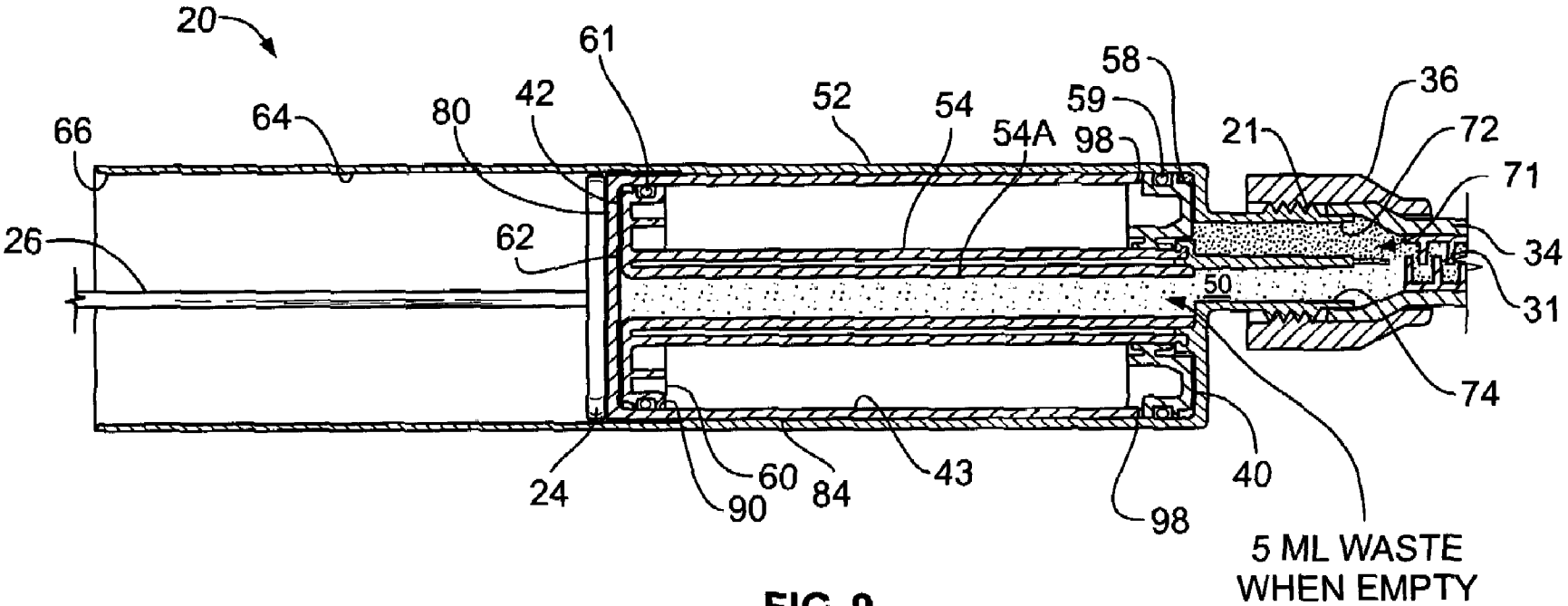
FIGS. 9-11 are longitudinal sectional views of other embodiments of a dual fluid cartridge of the present invention.
Figure 10:
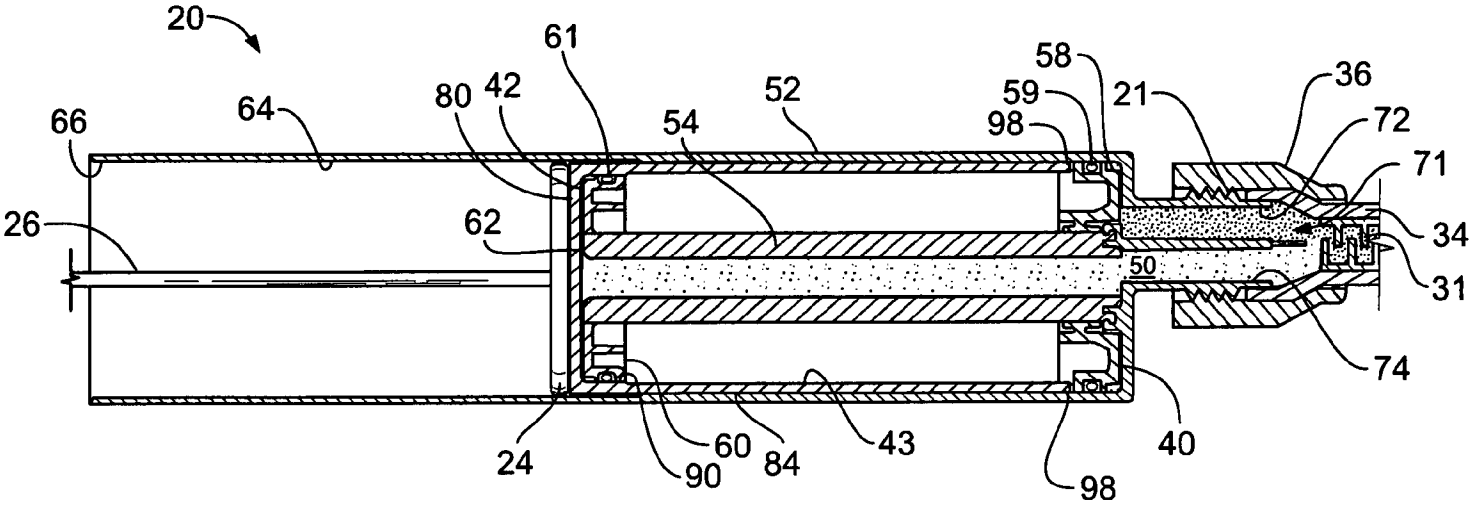
Figure 11:
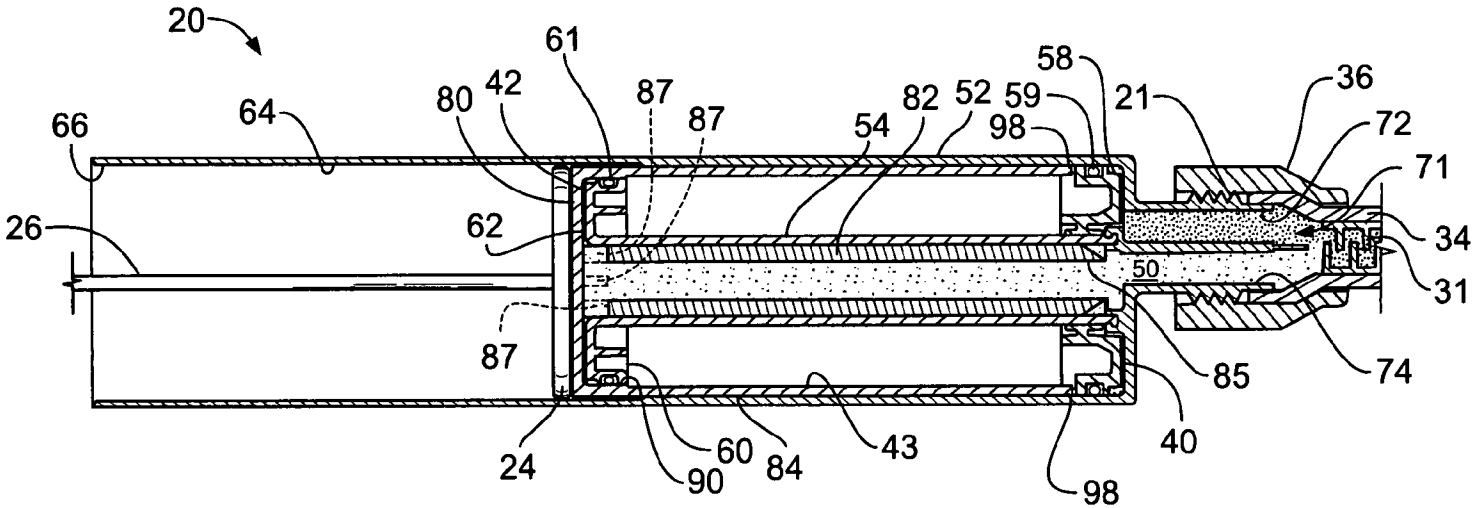

It should be understood that many differing embodiments of the dual fluid cartridge 20 of the present invention may be designed and employed. Referring to FIGS. 9-11, several other embodiments of the dual fluid cartridge 20 of the present invention are depicted. Referring to FIGS. 9 and 10, in these embodiments, the post 82 is removed and the inner diameter of the delivery tube 54 is reduced to reduce the amount of residual waste left after product is dispensed. In the embodiment of FIG. 9, an inner delivery tube 54A is disposed interior to and formed integral with the existing delivery tube 54. In the embodiment of FIG. 10, the wall of the delivery tube 54 is thickened to reduce the inner diameter of the delivery tube 54. Referring to FIG. 11, this embodiment includes a post 82, but instead of the post 82 having a groove 83 formed therein, a passage 85 is formed through the center of the post 82. In this embodiment, then fluid being dispensed from the chamber 42 is pushed through supply windows 87 formed in the top of the post 82 and down through the center passage 85 of the post 82 and into the discharge opening 74.

While the invention has been discussed in terms of certain embodiments, it should be appreciated that the invention is not so limited. The embodiments are explained herein by way of example, and there are numerous modifications, variations and other embodiments that may be employed that would still be within the scope of the present invention.

What is claimed is:

1. A fluid cartridge for storing and dispensing two fluids, comprising:

an outer cartridge wall defining an outlet and an open end opposite the outlet;

a delivery tube disposed within the outer cartridge wall and defining an outlet that is co-located with the outlet defined by the outer cartridge wall;

a first piston disposed between the outer cartridge wall and the delivery tube forming a first fluid chamber;

a second piston disposed within the outer cartridge wall between the first piston and the open end of the outer cartridge wall;

a post connected to and extending from the second piston in alignment with the delivery tube, wherein the post has a single groove formed on an outer surface thereof along the length of the post;

a fixed wall disposed between the first piston and the second piston, wherein the fixed wall and the second piston define a second fluid chamber; and means for transmitting force from the second piston to the first piston.

2. The fluid cartridge of claim 1, wherein the groove is formed in the post such that the post is kidney-shaped.

3. The fluid cartridge of claim 1, wherein the groove formed in the post is square.

4. The fluid cartridge of claim 1, wherein the groove formed in the post is round.

5. The fluid cartridge of claim 1, wherein the groove formed in the post is a channel.

6. The fluid cartridge of claim 1, wherein the delivery tube has an inner diameter and the post has an outer diameter and the outer diameter of the post is approximately equal to the inner diameter of the of the delivery tube.

7. The fluid cartridge of claim 1, further comprising passageways formed in the second fluid chamber for evacuating air trapped in the second chamber during the filling process.

8. A fluid cartridge for storing and dispensing two fluids, comprising:

an outer cartridge wall defining an outlet and an open end opposite the outlet;

a delivery tube disposed within the outer cartridge wall and defining an outlet that is co-located with the outlet defined by the outer cartridge wall;

a first piston disposed between the outer cartridge wall and the delivery tube forming a first fluid chamber;

a second piston disposed within the outer cartridge wall between the first piston and the open end of the outer cartridge wall;

a post connected to and extending from the second piston in alignment with the delivery tube, wherein the post has a single groove formed on an outer surface thereof along the length of the post;

a fixed wall disposed between the first piston and the second piston, wherein the fixed wall and the second piston define a second fluid chamber; and a transmission structure disposed between the second piston and the first piston.

9. The fluid cartridge of claim 8, wherein the groove is formed in the post such that the post is kidney-shaped.

10. The fluid cartridge of claim 8, wherein the groove formed in the post is square.

11. The fluid cartridge of claim 8, wherein the groove formed in the post is round.

12. The fluid cartridge of claim 8, wherein the groove formed in the post is a channel.

13. The fluid cartridge of claim 8, wherein the delivery tube has an inner diameter and the post has an outer diameter and the outer diameter of the post is approximately equal to the inner diameter of the of the delivery tube.

14. The fluid cartridge of claim 8, wherein the transmission structure has a step surface formed thereon, and at least one passageway is formed in the step surface for evacuating air trapped in the second chamber during the filling process.

15. The fluid cartridge of claim 14, wherein at least one passageway is formed in the second piston and said passageway is in communication with the passageway formed in the step surface formed on the transmission structure.

16. A fluid cartridge for storing and dispensing two fluids, comprising:

an outer cartridge wall defining an outlet and an open end opposite the outlet;

a delivery tube disposed within the outer cartridge wall and defining an outlet that is co-located with the outlet defined by the outer cartridge wall;

a first piston disposed between the outer cartridge wall and the delivery tube forming a first fluid chamber;

a second piston disposed within the outer cartridge wall between the first piston and the open end of the outer cartridge wall;

a post connected to and extending from the second piston in alignment with the delivery tube;

a fluid passage formed along the length of the post and extending not more than half of the peripheral distance around the post;

a fixed wall disposed between the first piston and the second piston, wherein the fixed wall and the second piston define a second fluid chamber; and transmission structure disposed between the second piston and the first piston.

* * * * *